US007375267B2

(12) United States Patent
Poschelk

(10) Patent No.: US 7,375,267 B2
(45) Date of Patent: May 20, 2008

(54) STRING INSTRUMENT WITH A DETACHABLE NECK

(75) Inventor: Kevin Poschelk, Bowen (AU)

(73) Assignee: KK Poschelk Pty Ltd, Bowen, Queensland (AU)

( * ) Notice: Subject to any disclaimer, the term of this patent is extended or adjusted under 35 U.S.C. 154(b) by 0 days.

(21) Appl. No.: 10/560,610

(22) PCT Filed: Jun. 18, 2004

(86) PCT No.: PCT/AU2004/000804

§ 371 (c)(1),
(2), (4) Date: May 12, 2006

(87) PCT Pub. No.: WO2004/114276

PCT Pub. Date: Dec. 29, 2004

(65) Prior Publication Data

US 2007/0056429 A1 Mar. 15, 2007

(30) Foreign Application Priority Data

Jun. 20, 2003 (AU) ..... 2003903145

(51) Int. Cl.
*G10D 3/00* (2006.01)

(52) U.S. Cl. ..... 84/291; 84/293

(58) Field of Classification Search ..... 84/293, 84/291, 290, 267
See application file for complete search history.

(56) References Cited

U.S. PATENT DOCUMENTS

| | | | | |
|---|---|---|---|---|
| 4,191,085 A | | 3/1980 | Litwin | |
| 4,638,708 A | | 1/1987 | Kamal | |
| 5,233,896 A | | 8/1993 | Worthington et al. | |
| 5,353,672 A | * | 10/1994 | Stewart | 84/291 |
| 6,025,548 A | | 2/2000 | Ehrlich | |
| 6,028,255 A | * | 2/2000 | Myronyk | 84/293 |

FOREIGN PATENT DOCUMENTS

| | | |
|---|---|---|
| FR | 2429471 | 1/1980 |
| GB | 2365198 | 2/2002 |

* cited by examiner

*Primary Examiner*—Kimberly Lockett
(74) *Attorney, Agent, or Firm*—Shoemaker and Mattare

(57) ABSTRACT

The present invention is directed to a guitar that has a detachable neck for ease of transport and storage. The body is attached to the neck in the preferred embodiment by means of a lever actuating clamp providing a clamping force substantially parallel with the longitudinal axis of the neck and body and the tensioned strings so that when reassembled the guitar strings regain their prior pre-assembled state of tune.

10 Claims, 8 Drawing Sheets

STRING INSTRUMENT WITH A DETACHABLE NECK

FIELD OF INVENTION

The present invention relates to string instruments and in particular to guitars. Reference is made to guitars in the body of the specification by way of example only.

BACKGROUND

Conventional guitars comprise a body and neck with strings stretched and tensioned between the distal end of the neck and a bridge mounted in the body. The neck is usually integral with the body of the guitar. However, the size of the guitar makes the instrument difficult and awkward to transport or store. This problem is particularly relevant when guitars are transported by commercial carriers such as airlines where storage space is limited. On airlines, the guitar is usually too large for storage as hand luggage and must be stored in a well padded case to protect it from the rough handling often experienced by checked baggage.

As a consequence travel guitars have been developed. These include guitars with hinged necks that are able to fold back on themselves. An example of a guitar with a hinged neck is disclosed in U.S. Pat. No. 4,073,211, but in order for the neck to fold back the neck-hinge portion must be thin and the strings are overstretched. Thin necks provide flexibility which affects the pitch and tune of the guitar. Similarly overstretched strings change the tune and the guitar must be retuned prior to playing. To overcome the problem with overstretched strings, a guitar with a complex system of gears and rollers to relax the tension of the strings so the neck can be folded was developed and disclosed in U.S. Pat. No. 4,111,093. With another approach guitars such as the one disclosed in U.S. Pat. No. 4,686,882 were developed that were foldable with collapsible bodies.

In also addressing the problem, U.S. Pat. No. 5,353,672 discloses a guitar with a detachable neck. The guitar has a releasable latch mechanism comprising a neck plate fixed to the underside of the neck and a spring biased latch on the body and engageable with the neck. The latch mechanism holds the neck and body in position while releasable fasteners are used to tighten the neck plate and body together and relieve the latch from the forces pulling the neck away from the guitar body. The disadvantage with the disclosed guitar is that assembly is complicated by positioning the neck relative to the body with the latch mechanism and then using fasteners to secure the position. The reattachment is not reproducible as the fasteners can be fastened to varying degrees thereby affecting the sound produced by the guitar. As well the latch and latch lip may with time bend under the constant strain of the opposing forces and fail to reproducibly and accurately position the neck relative to the guitar body.

OBJECT OF THE INVENTION

It is an object of the present invention to provide a string instrument with an alternate means of detaching the neck from the body of the string instrument.

STATEMENT OF THE INVENTION

In one aspect the present invention broadly resides in a string instrument Including a body and neck with a plurality of strings attachable to the neck and body; and detachment means for detaching the neck from the body, said detachment means includes a clamping means which has a clamping arm extendable from either the neck or body and a securing means for securing the clamping arm on the other guitar portion; wherein the clamping force produced from the assembled instrument is substantially parallel with the longitudinal axis of the neck and body.

Preferably the clamping arm extends from the neck and is securable by a retaining means fixed to the body. Preferably the clamping arm is a threaded rod with an adjustable nut. The threaded rod and nut is secured by a body retaining means which is preferably a slotted member.

In another aspect the present invention broadly resides in a string instrument including a body and neck with a plurality of strings attachable to the neck and body; and detachment means for detaching the neck from the body, said detachment means includes a clamping means which has a clamping arm engageable with the neck and actuated by biased linkage means, said biased linkage means is associated with the body; wherein the clamping force produced from the assembled instrument is substantially parallel with the longitudinal axis of the neck and body.

The biased linkage means preferably includes a pivotal lever. The lever is preferably pivotally attached to the guitar body by an offset pivot. The lever is preferably also pivotally connected to the clamping arm so that the clamping arm reciprocates when the lever moves about its pivot. Alternatively the biased linkage means may include a cam linkage between a lever and the clamping arm. In a further alternative the biased linkage means may be a quadrant linkage where a substantially triangular member is pivotally connected to the body at one apex while a lever is attached at a second apex and the clamping arm is attached at a third apex.

In another aspect the present invention broadly resides in a string instrument including a body and neck with a plurality of strings attachable to the neck and body; and detachment means for detaching the neck from the body, said detachment means includes a clamping means which has a clamping arm engageable with the neck and actuated by biased linkage means, said biased linkage means includes a lever pivotally connected to the body by an offset pivot and pivotally connected to the clamping arm so that the clamping arm reciprocates when the lever moves about its pivot, wherein the clamping force produced from the assembled instrument is substantially parallel with the longitudinal axis of the neck and body.

The lever is preferably connected to the lower side of the body. More preferably the lever and clamping arm may be positioned within a recess in the lower side of the body.

The clamping arm preferably has an engagement portion for engaging the neck. The clamping arm is preferably T-shaped.

The neck preferably has a clamp support for engagement with the clamping arm. The clamp support is preferably attached to the underside (non-fret side) of the neck.

In one preferred embodiment, the clamp support has a locating portion for locating the neck relative to the body prior to clamping. The locating portion preferably includes a recess in which a locating projection on the body or clamping arm may be positioned. The positioning of the locating projection within the locating recess preferably locates the clamp support relative to the body so that the neck may be suitably clamped to the body. Preferably the clamp support can also pivot about the locating projection positioned within the recess.

After the clamp arm has engaged the clamp support, the lever is preferably rotated backwards and the clamping arm clamps the clamp support and neck to the body. In this manner the clamping force is substantially parallel with the longitudinal axis of the neck and body and preferably parallel with the tensioned strings.

In another aspect the invention broadly resides in a string instrument including:

a body and neck with a plurality of strings attachable to the neck and body; and detachment means for detaching the neck from the body, said detachment means includes a clamping means which has a clamping arm engageable with the neck and actuated by biased linkage means, said biased linkage means is associated with the body; wherein the clamping force produced from the assembled instrument clamps the clamping arm against the neck.

In a further aspect the invention broadly resides in a string instrument including:

a body and neck with a plurality of strings attachable to the neck and body; and detachment means for detaching the neck from the body, said detachment means includes a clamping means which has a clamping arm engageable with the neck and actuated by biased linkage means, said biased linkage means is associated with the body; the neck has a clamp support on the underside (non-fret side) of the neck for engagement with the clamping arm; wherein the clamping force produced from the assembled instrument clamps the clamping arm against the clamp support.

The string instrument described in any one of the above mentioned aspects and embodiments is preferably a guitar.

BRIEF DESCRIPTION OF THE DRAWINGS

In order that the present invention be more readily understood and put into practical effect, reference will now be made to the accompanying drawings wherein.

DETAILED DESCRIPTION OF THE PREFERRED EMBODIMENT

Figure 1A:
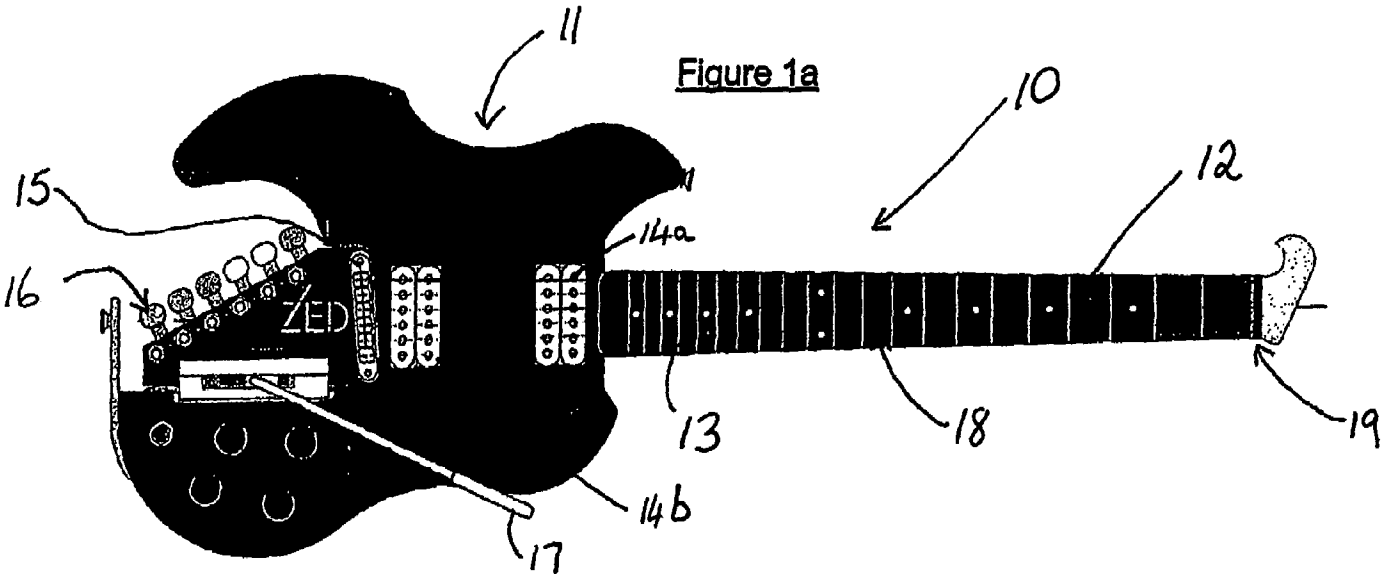
FIG. 1*a* is a diagrammatic view of the top side (fret and string side) of a guitar of the preferred embodiment.
Figure 1B:
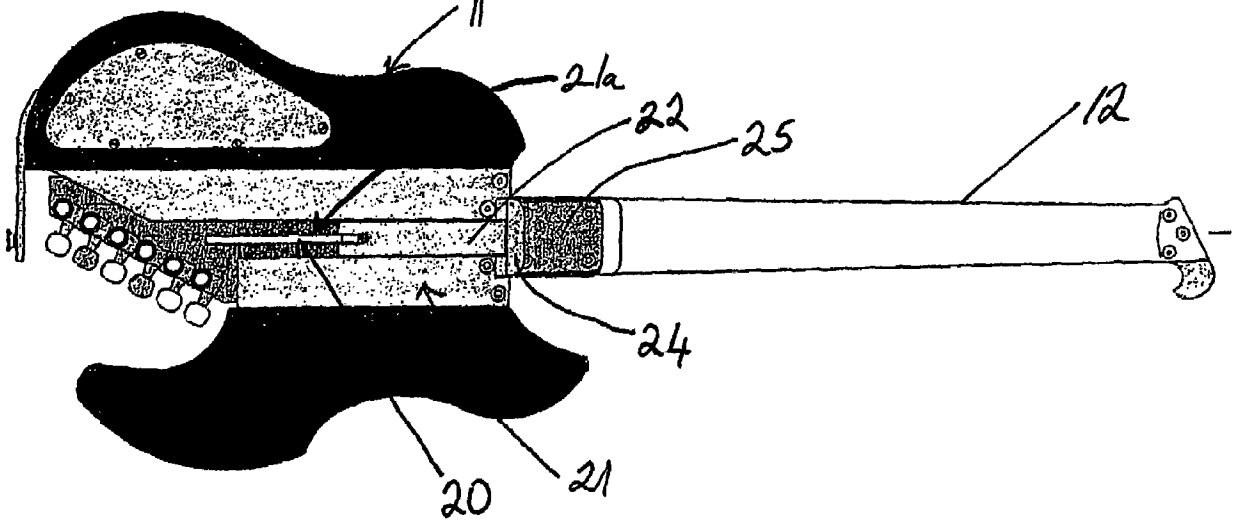
FIG. 1*b* is a diagrammatic view of a lower side of a guitar of the preferred embodiment.

With reference to FIGS. 1*a* and 1*b*, there is shown a guitar 10 with body 11 and neck 12. The neck 12 has a fret board 13 on its upper surface. The body 11 has neck pick-ups 14*a* and bridge pick-ups 14*b*, bridge 15, machine heads 16 and tremolo arm 17 on the upper surface. Guitar strings 18 are attached to and tensioned between the string nut 19 and bridge 15.

The guitar body 11 also has a release lever 20 pivotally attached within a recess 21*a* formed in the clamp-body base 21. A clamping arm 22 is pivotally connected to the lever 20 by an offset pivot connection 23 (shown in FIG. 3). The clamping arm 22 is substantially T-shaped with a clamping head 24.

Figure 2:
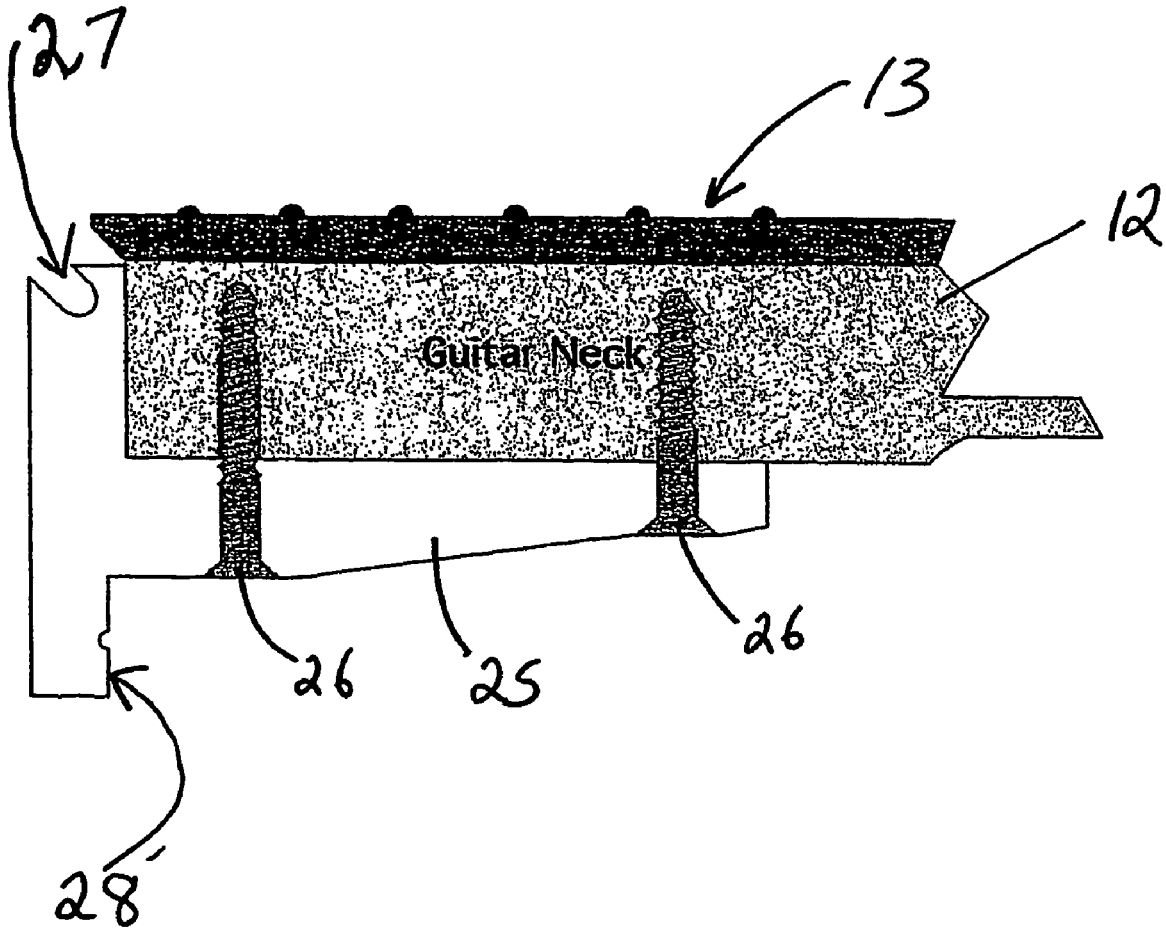
FIG. 2 is diagrammatic view of the guitar neck and clamp support.
Figure 3A:
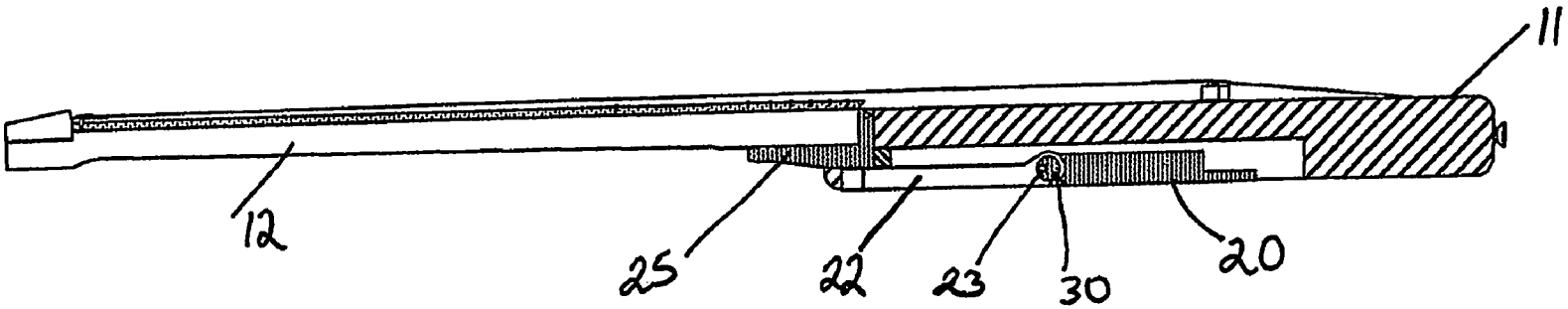
FIG. 3*a*-3*g* is a diagrammatic view of the attachment of the neck to the body of the guitar of the preferred embodiment.
Figure 3B:
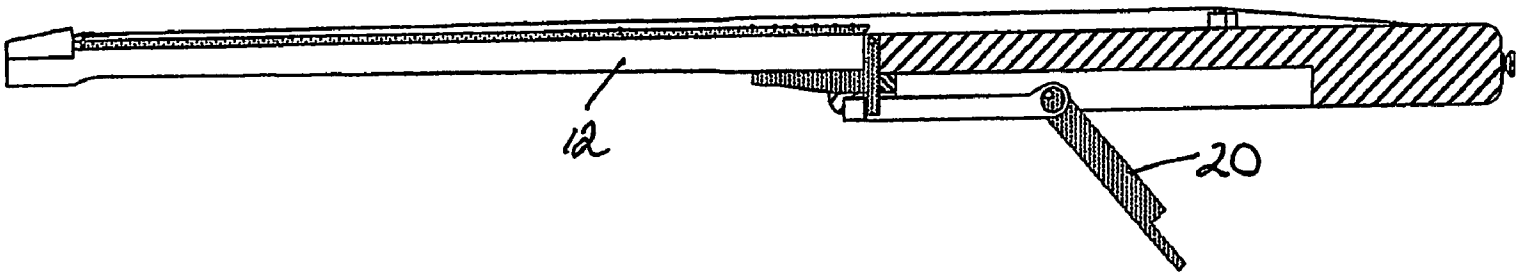
Figure 3C:
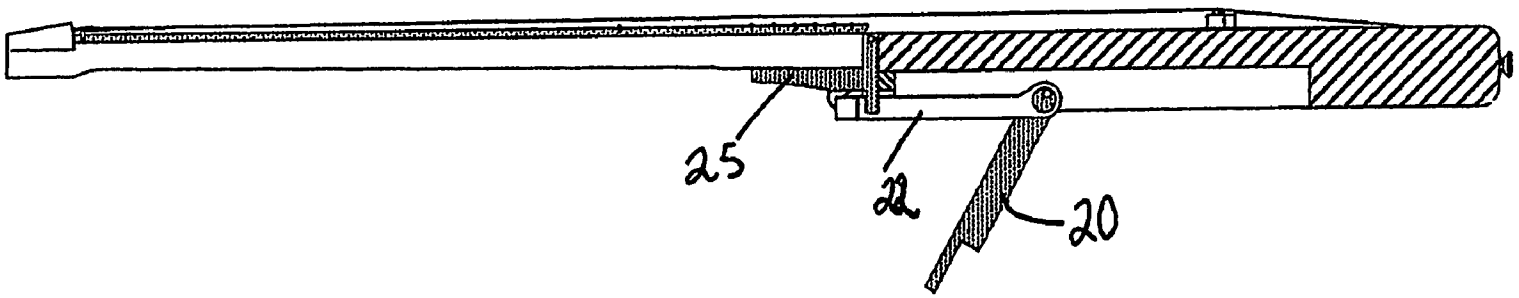
Figure 3D:
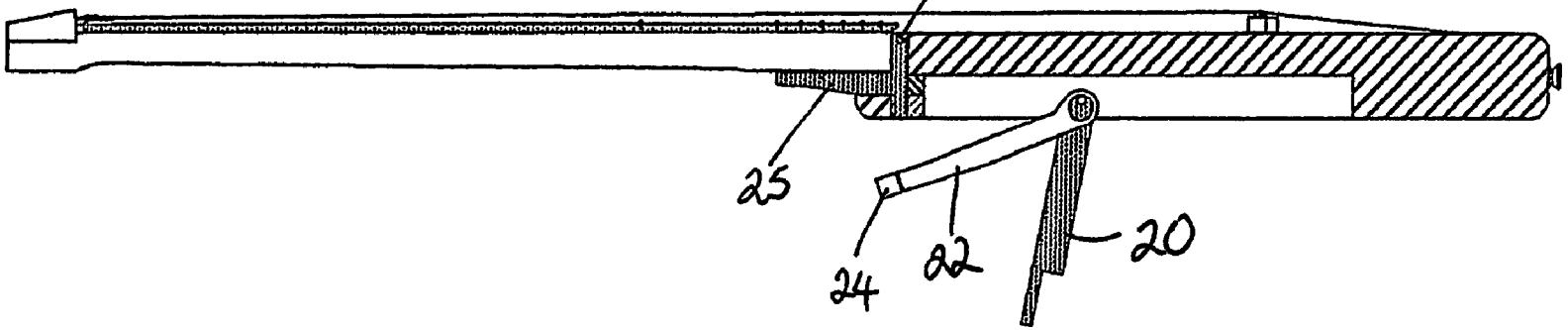
Figure 3E:
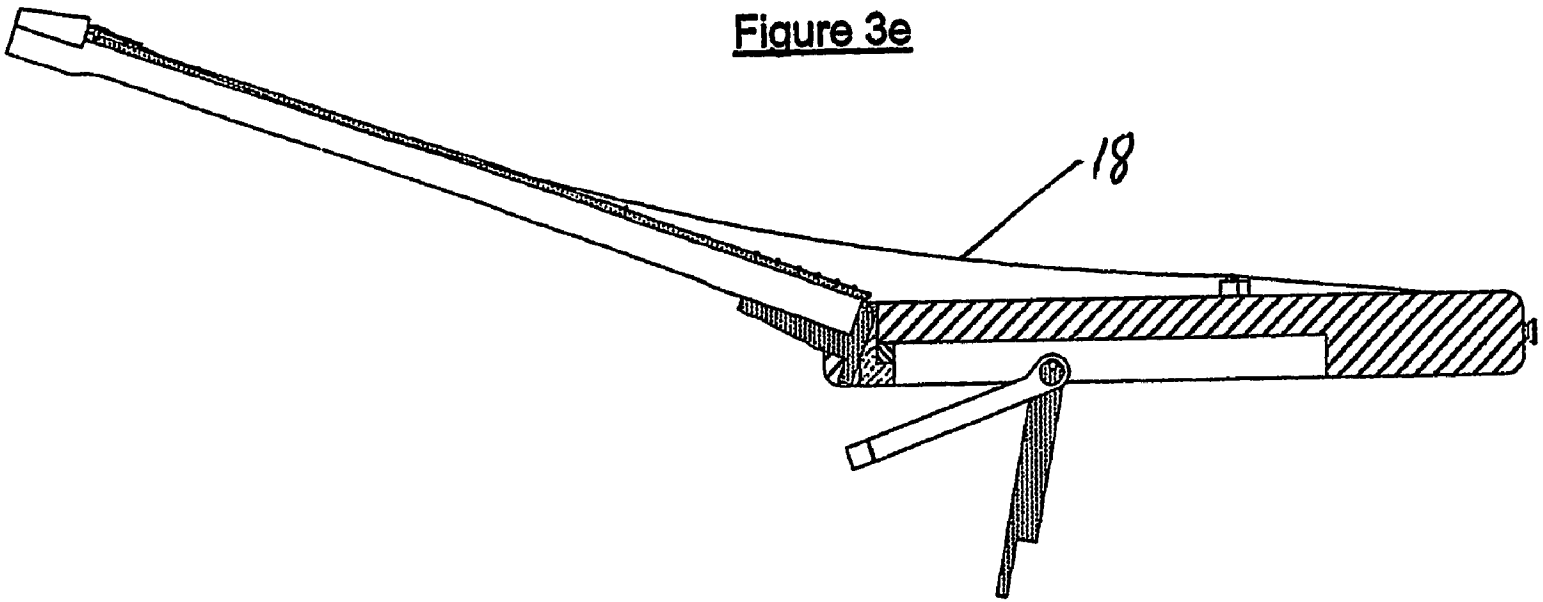
Figures 3F, 3G:
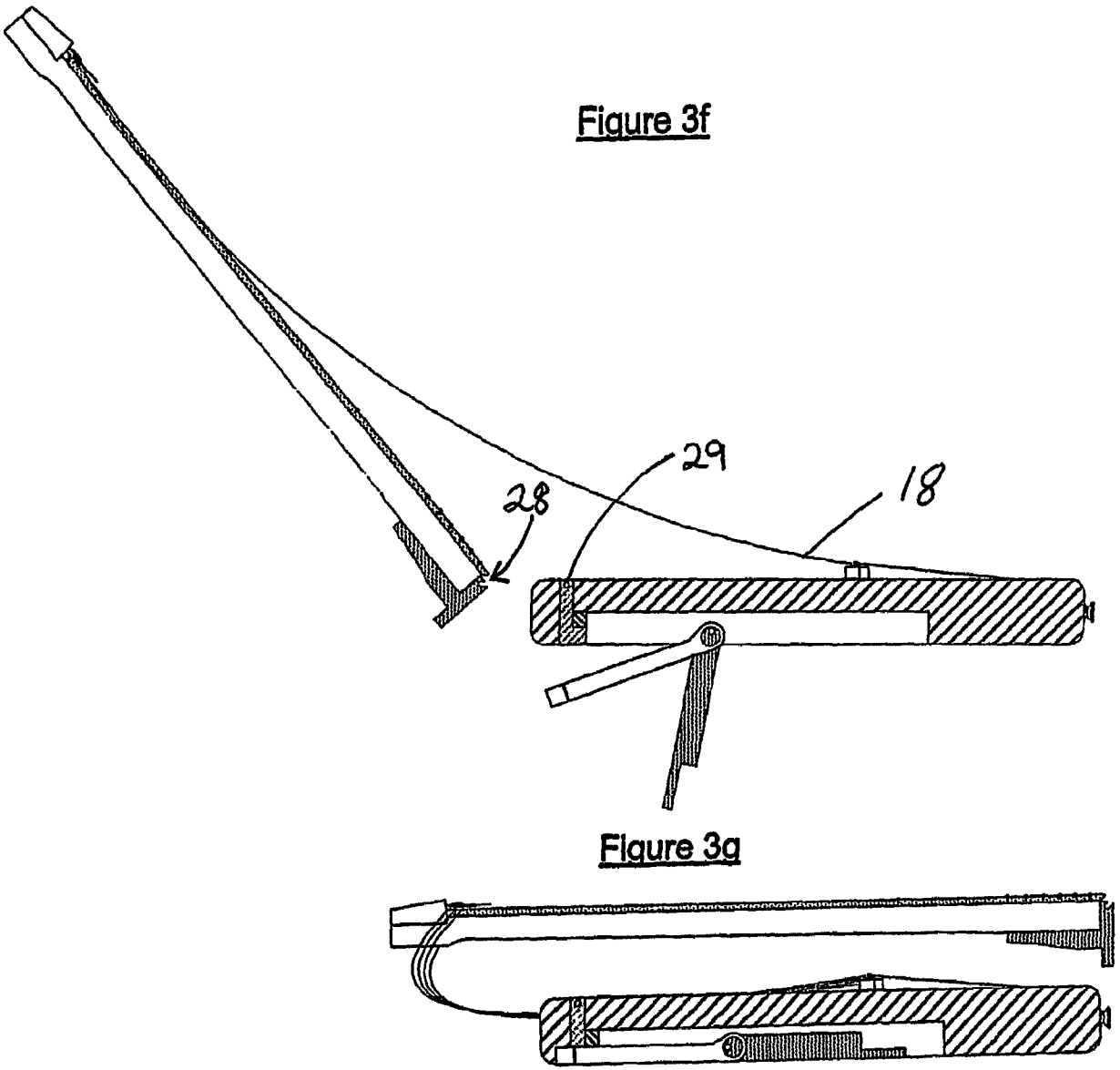
Figure 4A:
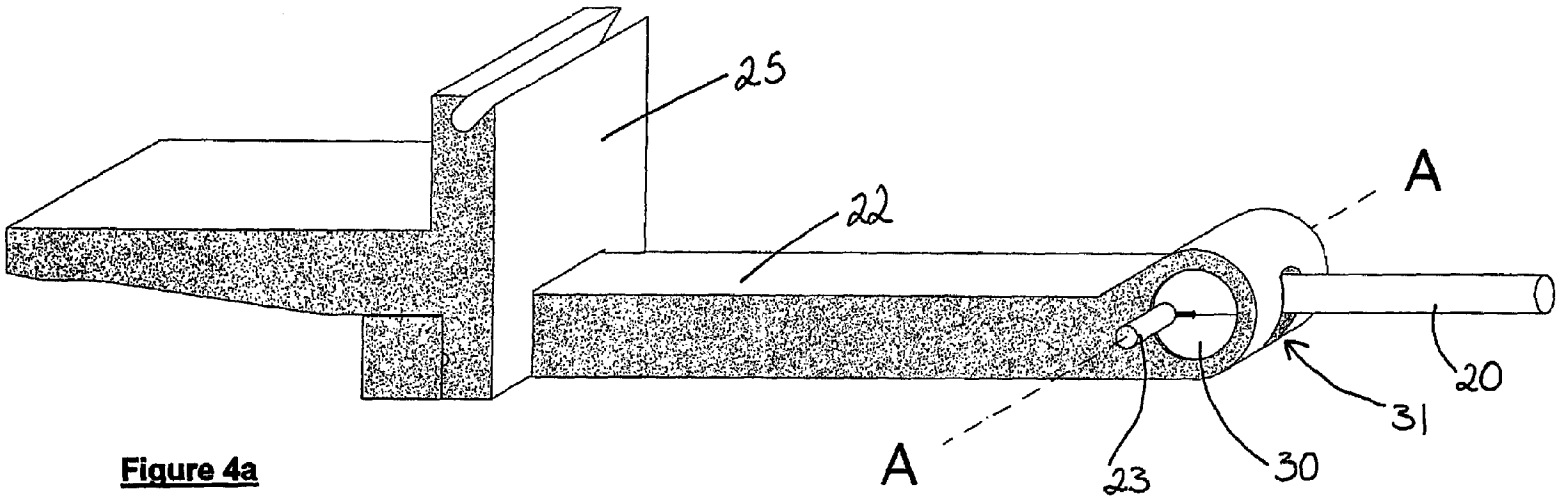
FIG. 4*a*-4*d* is a diagrammatic view of the lever and clamping arm pivot connection of the preferred embodiment.
Figure 4B:
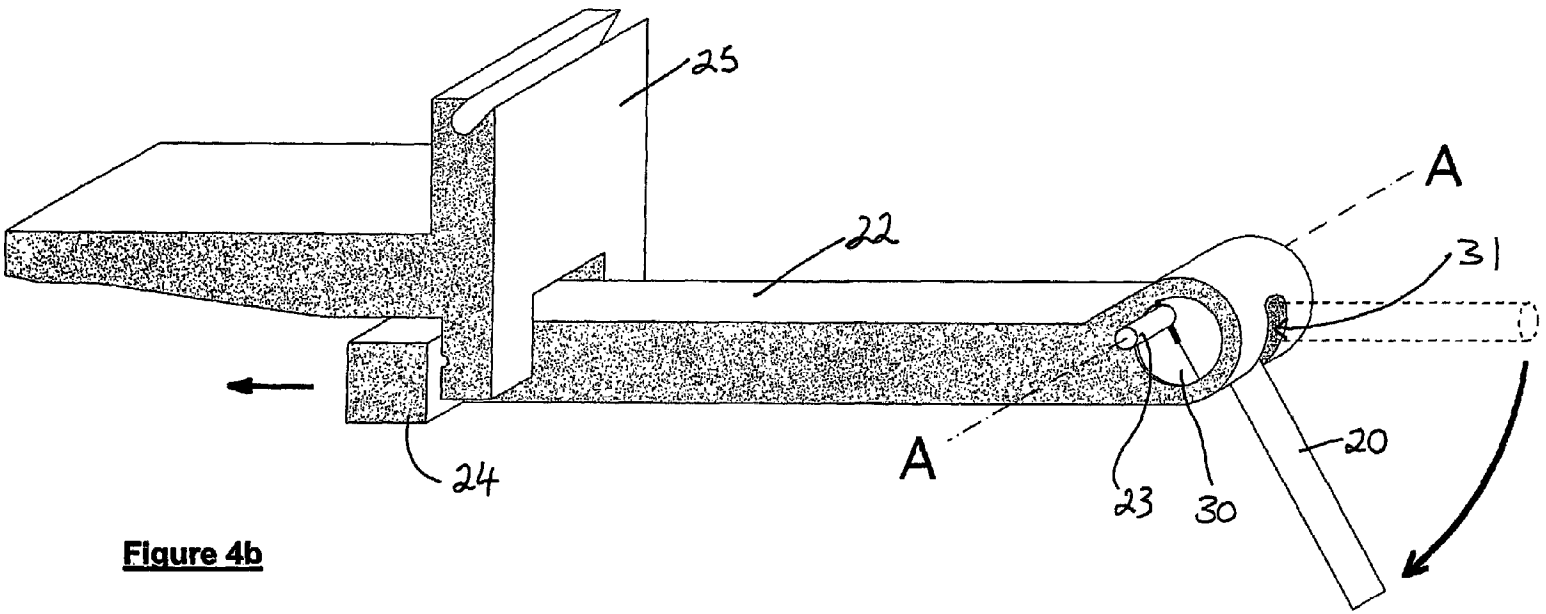
Figure 4C:
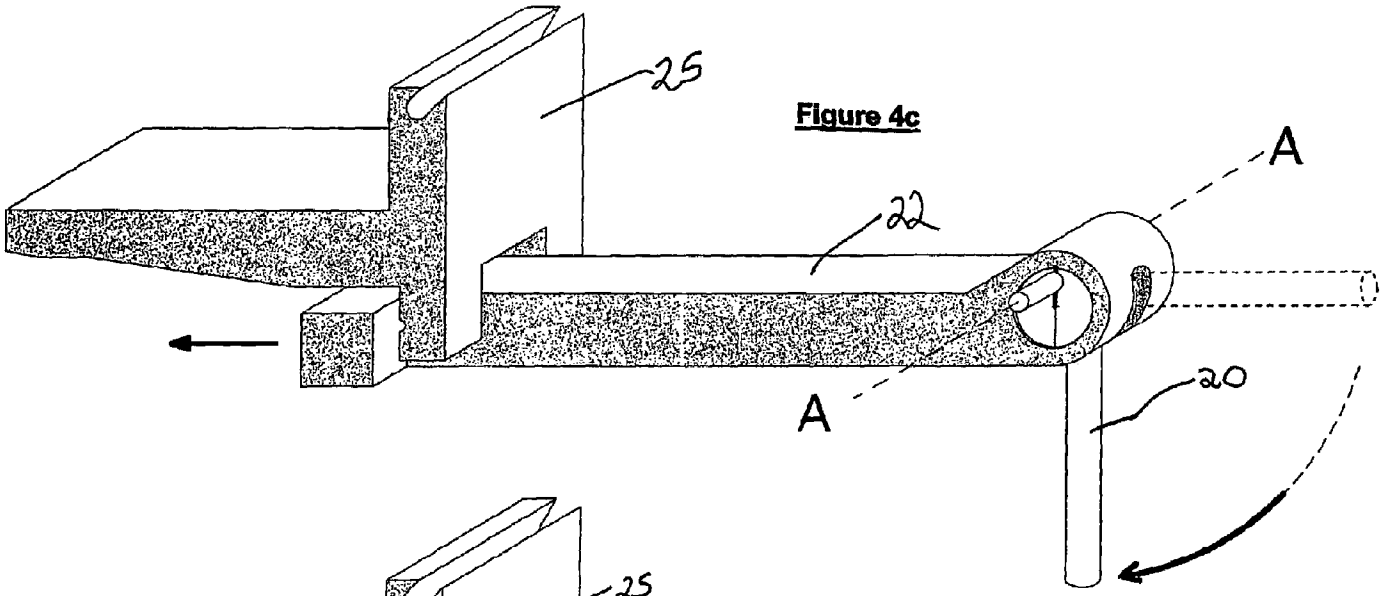
Figure 4D:
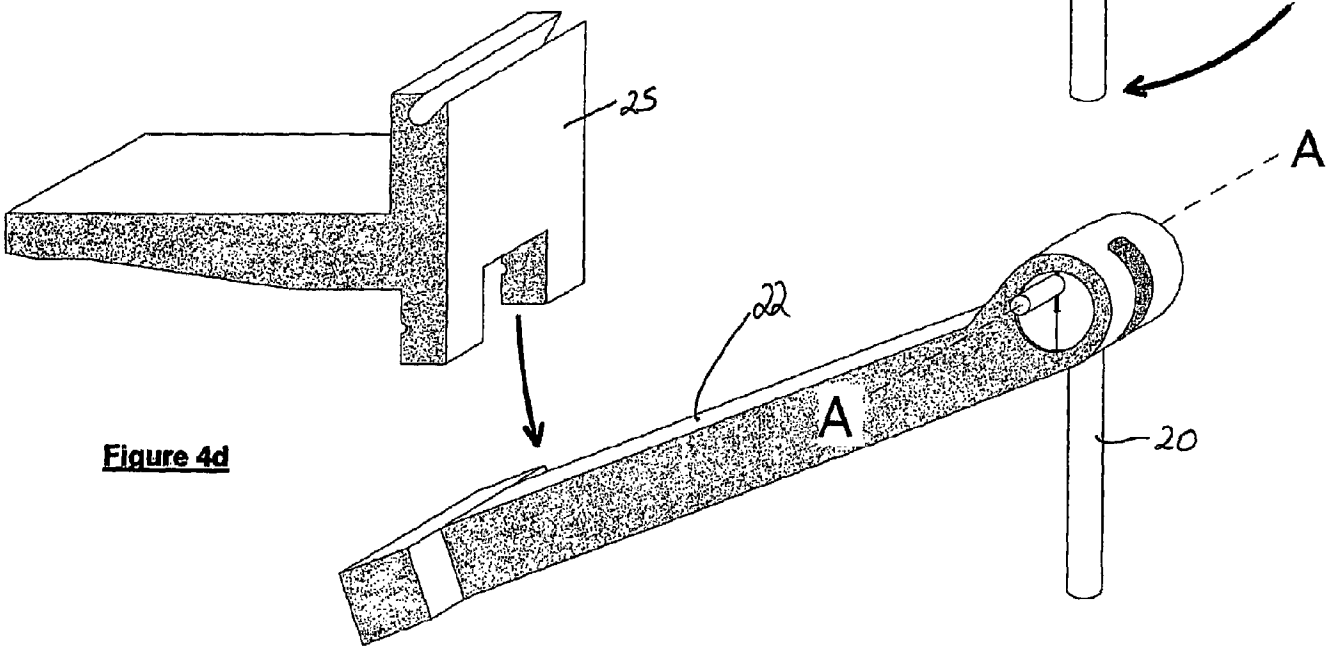

The neck 12 has a clamp support 25 attached to the lower side of the neck 12. With reference to FIG. 2, the clamp support 25 is fixed to the underside of the neck 12 by screws 26. Other types of fasteners may be used to fix the clamp support 25 instead of screws 26. The clamp support 25 has a securing portion 28 to which the clamping head 24 abuts and clamps the clamp support 25 to the body 11. The clamp support 25 also has a vertically or diagonally disposed recess 27 for locating the clamp support 25 to the guitar body 11. A projection 29 (shown in FIG. 3) is locatable within recess 27.

The clamp-body base 21, clamping arm 22, lever 20 and clamp support 25 are made of metal.

FIGS. 3*a*-3*g* show the progressive detachment of the neck 12 from the body 11. In these figures there is shown the guitar 10 comprising body 11 and neck 12. Lever 20 is located within recess 21 when the guitar 10 is in the assembled position. The lever 20 is pivotally connected to the guitar body by offset pivot pin 23. The axis of the offset pivot pin 23 is shown as A—A in FIG. 4. The lever 20 is also pivotally connected by pivot 30 to the clamping arm 22. As the lever 20 rotates about the centre axis of pivot 30 and along slot 31, the clamping arm 22 is pushed forward because of the off centre pivot pin 23 thereby disengaging the clamp. The progressive stages of using the pivots to disengage the clamp is shown in FIGS. 4*a*-4*d*.

To detach the neck 12 from the body 11, the lever 20 rotates about its pivot 30 thereby moving the clamping arm 22 forwards towards the neck 12. The movement of the clamping arm 22 forwards releases the clamp support 25. The neck 12 can pivot upwardly about projection 29 thereby releasing tension on the strings 18 and preventing them from overstretching. The clamp support 25 can subsequently be removed from engagement with projection 29. The neck 12 and body 11 form two separate components connected together only by strings 18.

Figure 5:
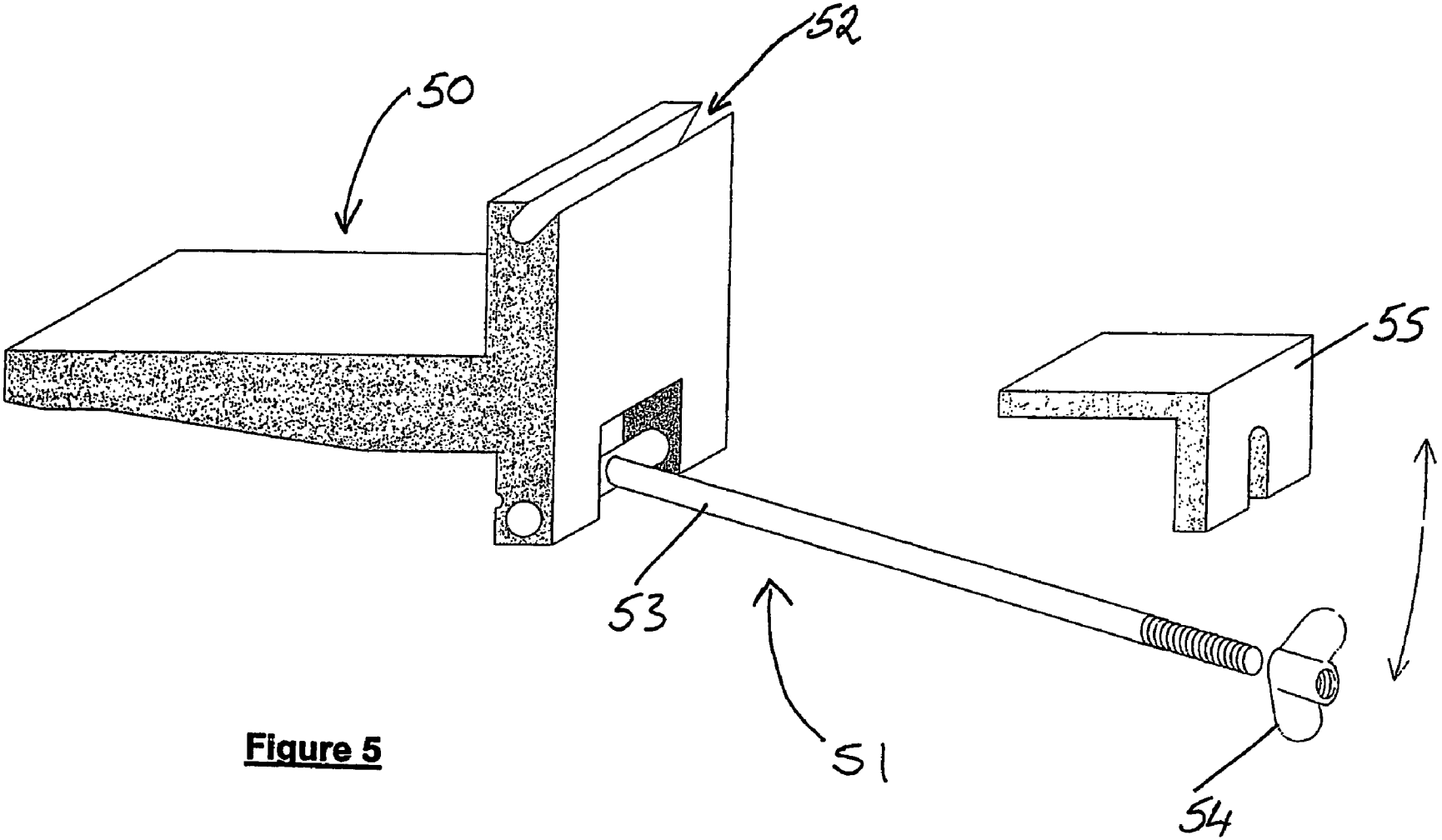
FIG. 5 is a diagrammatic view of a second embodiment of the clamping arm and clamp support

In a second embodiment shown in FIG. 5, there is a clamp support 50 with a pivotal clamping arm 51 and locating recess 52. The clamping arm 51 includes a threaded rod 53 with an adjustable nut 54. The threaded rod 53 and nut 54 is secured by a slotted bracket 55. The slotted bracket 55 is fixed to the guitar body.

ADVANTAGES

The advantages of the preferred embodiment of the present invention include providing a guitar with a detachable neck for ease of transport and storage. The body is attached to the neck in the preferred embodiment by means of a lever actuating clamp providing a clamping force substantially parallel with the longitudinal axis of the neck and body and the tensioned strings so that when reassembled the guitar strings regain their prior pre-assembled state of tune.

A further advantage of the preferred embodiment is that adequate space is provided for the normal positioning of the pickups on an electric guitar. The neck pickup can be positioned in close proximity with the twenty-second fret.

With the preferred embodiment, the assembled guitar has a stiff and non-flexible neck—body portion produced by the tension from the T clamping arm and the elongate length of the clamping arm maintains the string tuning of the assembled guitar.

The use of a single lever action provides the assembled guitar with the same reproducible tension thereby enabling the guitar to produce a consistent sound. The use of a single lever also provides for a quick release to detach the neck from the body and a corresponding quick assembly.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

The invention claimed is:

1. A string instrument including two portions being a body and a neck and having a plurality of strings extendable between the neck and the body; and a detachment assembly for detaching the neck from the body, wherein said detachment assembly includes a clamping member attached to a first portion of the two portions and engageable with a retainer member attached to a second portion of the two portions, said clamping member includes a positioning portion and a clamping arm, said clamping arm is actuated by a pivotally connected lever and positioned to be substantially parallel with the longitudinal axis of the first portion when clamping, and said lever is connected by an offset pivot linkage to the first portion;

wherein in use the retainer member engages the positioning portion and pivots about the positioning portion enabling the clamping arm to engage and clamp the retainer member with actuation of the lever thereby locking the two portions together to assemble the instrument and the clamping force produced from the assembled instrument is substantially parallel with the longitudinal axis of the neck and body.

2. A string instrument including a body and a neck and having a plurality of strings extendable between the neck and the body; and a detachment assembly for detaching the neck from the body, wherein said detachment assembly includes a clamping member attached to the body and engageable with a retainer member attached to the neck, said clamping member includes a positioning portion and a clamping arm, said clamping arm is actuated by a pivotally connected lever and positioned to be substantially parallel with the longitudinal axis of the body when clamping, and said lever is connected by an offset pivot linkage to the body;

wherein in use the retainer member engages the positioning portion and pivots about the positioning portion enabling the clamping arm to engage and clamp the retainer member with actuation of the lever thereby locking the neck and body together to assemble the instrument and the clamping force produced from the assembled instrument is substantially parallel with the longitudinal axis of the neck and body.

3. A string instrument as claimed in claim 2, wherein the offset pivot linkage to the body enables the clamping arm to reciprocate when the lever moves about its pivot.

4. A string instrument as claimed in claim 2, wherein the offset pivot linkage includes an offset pivot pin on the lever pivot and is attached to the body so that when the lever moves the clamping arm moves to tighten or loosen the clamping with the retainer member.

5. A string instrument as claimed in claim 2, wherein the lever is connected to the lower side of the body and the lever and clamping arm are positioned within a recess in the lower side of the body.

6. A string instrument as claimed in claim 2, wherein the clamping arm is T-shaped.

7. A string instrument as claimed in 2, wherein the retainer member has a clamp support for engagement with the clamping arm, the clamp support is attached to the underside (non-fret side) of the neck.

8. A string instrument as claimed in claim 2, wherein the retainer member has a locating portion for locating the neck relative to the body prior to clamping; and the locating portion is adapted to engage with the positioning portion on the clamping member so that the neck can pivot about the positioning member for clamping engagement.

9. A string instrument as claimed in claim 2, wherein the retainer member has a locating portion for locating the neck relative to the body prior to clamping; and the locating portion is adapted to engage with the positioning portion on the clamping member so that the neck can pivot about the positioning member for clamping engagement, said locating portion includes a recess and the positioning portion includes a projection adapted for engagement within the recess of the locating portion.

10. A string instrument as claimed in claim 2, wherein the string instrument is a guitar.

* * * * *